US005865010A

United States Patent [19]

Sundby et al.

[11] Patent Number: 5,865,010

[45] Date of Patent: Feb. 2, 1999

[54] FILLING MACHINE HAVING A COMPARTMENTALIZED CLEAN AIR SYSTEM ENCLOSING THE FILLING SYSTEM THEREOF

[75] Inventors: Paul C. Sundby, Mahtomedi; Terry D. Erickson, St. Paul; John N. Lees, Minneapolis; David Hansen, St. Paul, all of Minn.

[73] Assignee: Tetra Laval Holdings & Finance SA, Pully, Switzerland

[21] Appl. No.: 828,329

[22] Filed: Mar. 28, 1997

[51] Int. Cl.[6] ..... B65B 55/00

[52] U.S. Cl. ..... 53/167

[58] Field of Search ..... 53/167, 425, 426; 141/85, 89, 90, 91, 92

[56] References Cited

U.S. PATENT DOCUMENTS

| | | | |
|---|---|---|---|
| 3,466,841 | 9/1969 | Rausing | 53/426 |
| 3,566,575 | 3/1971 | Lisiecki | 53/167 X |
| 3,744,209 | 7/1973 | Cohley et al. | 53/426 |
| 3,820,300 | 6/1974 | Reinecke et al. | 53/167 X |
| 3,964,238 | 6/1976 | Bippus et al. | 53/167 |
| 4,014,158 | 3/1977 | Rausing | 53/167 |
| 4,035,981 | 7/1977 | Braun et al. | 53/167 X |
| 4,056,921 | 11/1977 | Gilliand et al. | 53/167 |
| 4,208,852 | 6/1980 | Pioch | 53/167 |
| 4,375,145 | 3/1983 | Mosse et al. | 53/425 |
| 4,503,656 | 3/1985 | Hautemont | 53/167 X |
| 4,533,515 | 8/1985 | Witter et al. | 53/425 X |
| 4,566,251 | 1/1986 | Spisak et al. | 53/167 |
| 4,590,734 | 5/1986 | Ueda | 53/167 X |
| 4,693,052 | 9/1987 | Rebmann et al. | 53/167 |
| 4,707,334 | 11/1987 | Gerhard | 53/167 X |
| 4,734,268 | 3/1988 | Redding et al. | 53/167 X |
| 4,803,827 | 2/1989 | Posey et al. . | |
| 4,944,132 | 7/1990 | Carlsson et al. . | |
| 4,964,444 | 10/1990 | Hanerus et al. | 53/425 X |
| 4,992,247 | 2/1991 | Foti . | |
| 5,053,196 | 10/1991 | Ide et al. | 53/167 X |
| 5,129,212 | 7/1992 | Duffey et al. . | |
| 5,152,968 | 10/1992 | Foti et al. . | |
| 5,488,811 | 2/1996 | Wang et al. . | |
| 5,534,222 | 7/1996 | Kelbrick et al. . | |
| 5,588,279 | 12/1996 | Runnberg et al. | 53/167 X |
| 5,673,535 | 10/1997 | Jagger | 53/167 X |
| 5,687,542 | 11/1997 | Lawecki et al. | 53/167 X |
| 5,720,148 | 2/1998 | Bedin et al. | 53/167 |
| 5,759,218 | 6/1998 | Martin et al. | 53/425 X |

*Primary Examiner*—Daniel B. Moon
*Attorney, Agent, or Firm*—Michael A. Catania

[57] ABSTRACT

A carton filling machine comprising a compartmentalized clean air system for providing a downward unidirectional flow of clean air into a chamber that substantially encloses one of the machine stations is provided. Preferably, the machine station is a filling station. Even more preferably the clean air system encloses both the fill pipe of the filling station and a top folding portion of a top sealing station of the machine. The top folding portion of the top sealing station ensures that the carton exits the chamber in a closed state whereby the carton is maintained in a very hygienic state after it has been filled in a very hygienic atmosphere. The air flow is advantageously divided into plural streams, one of which is directed about the fill pipe to further ensure sterile filling conditions.

5 Claims, 16 Drawing Sheets

FILLING MACHINE HAVING A COMPARTMENTALIZED CLEAN AIR SYSTEM ENCLOSING THE FILLING SYSTEM THEREOF

STATEMENT REGARDING FEDERALLY SPONSORED RESEARCH OR DEVELOPMENT

Not applicable.

CROSS-REFERENCE TO RELATED APPLICATIONS

Not applicable.

BACKGROUND OF THE INVENTION

The present invention relates to an apparatus for filling containers, and more particularly, to a compartmentalized clean air system for a filling machine. The compartmentalized clean air system encloses a machine station, preferably, the filling station, and provides unidirectional, substantially vertical air flow in the station of the filling machine. The compartmentalized clean air system further creates a pressurized region around, for example, the filling station that further enhances the sterility of the filling process.

Current packaging machine integrate various components necessary to fill and seal a container into a single machine unit. Such a packaging machine is used to perform a packaging process, which generally stated, includes feeding carton blanks into the machine to form cartons, sealing the bottom of the cartons, filling the cartons with the desired contents, sealing the tops of the cartons, and then off-loading the filled cartons for shipping.

Trends within the field of packaging machines point toward increasingly high capacity machines capable of rapid, continuous filling and sealing of a very large number of identical or similar packaging containers, e.g., containers of the type intended for liquid contents such as milk, juice, and the like. One such machine is disclosed in U.S. Pat. No. 5,488,812, issued Feb. 6, 1996, and entitled "Packaging Machine." The machine disclosed in that patent includes a plurality of processing stations, each station implementing one or more processes to form, fill, and seal the containers. Each of the processing stations is driven by one or more servomotors that drive the various components of each of the processing stations.

Another type of packaging machine is exemplified by the TR/7™ and TR/8™ packaging machines manufactured and available from Tetra Pak, Inc. Such machines are of a more conventional type in which many of the components are driven from a common drive motor through, for example, indexing gears and cam mechanisms.

Certain filling machines have various stations. For example, a carton forming station may be provided prior to a sterilizing station. Also a filling station and a sealing station are commonly provided. In some of these machines, the carton path may be enclosed or partially enclosed in a narrow tunnel to provide greater control over the cleanliness of the container during filling operations, etc. However, these tunnels enclosing the carton path are not necessarily optimal. First of all, the tunnels are difficult to clean, if cleaning is even possible due to the tight confines of the carton tunnel. As a result, automatic cleaning methods cannot be easily used with such carton tunnels. In addition, the tunnels make it difficult, if not impossible, to maintain a vertical air flow in the filling machine.

A further disadvantage of the tunnel is that it limits visibility of the cartons in the carton path so that if a crash of the cartons occurs, it cannot be readily be detected. Similarly, access is limited due to the restrictive arrangement of the tunnel enclosing the carton path. A related is that it creates a physical obstruction to manipulating the cartons by mechanical means.

There are also problems associated with known machines having sterile air ventilation systems. For example, these machines have difficulty controlling the air quality and maintaining desired air pressures within the machine. Furthermore, certain systems create recirculation paths for the air flow that allow settling regions for debris, liquid accumulation in the machine, and recontamination of the air stream and subsequently the partially packaged product. Another disadvantage is the inability to automatically clean and sterilize the surfaces in direct contact with the air.

BRIEF SUMMARY OF THE INVENTION

A carton filling machine comprising a compartmentalized clean air system for providing a unidirectional downward flow of clean air, suitable for aseptic packaging, into a chamber that substantially encloses one of the machine stations is provided. Preferably, the machine station is a filling station. Even more preferably the clean air system encloses both the fill pipe of the filling station and a top folding portion of a top sealing station of the machine. The top folding portion of the top sealing station ensures that the carton exits the chamber in a closed state whereby the carton is maintained in a very hygienic state after it has been filled in a very hygienic atmosphere. The air flow is advantageously divided into plural streams, one of which is directed about the fill pipe to further ensure sterile filling conditions.

In accordance with one embodiment of the clean air system, the system comprises an air intake arranged in fluid communication with supply of clean air. Clean air received at the air intake is communicated to a duct. The chamber is connected in fluid communication with the duct to receive the clean air. The chamber is defined by a first substantially vertical wall and a second substantially vertical wall disposed at a distance from the first wall such that the chamber encloses the fill pipe of the filling station.

In one embodiment, an air foil is arranged in the duct to divide the air supply in different air flow paths. An arcuate fin is arranged in the chamber proximate the fill pipe to increase the flow of sterile air in that region.

It is an advantage of a filling machine having a compartmentalized clean air system to provide positive air pressure at critical locations of the filling machine. For example, certain critical locations in the filling machine include sterile areas such as the fill system and the top folding system located prior to the final sealing of the carton.

Another advantage of a filling machine having a compartmentalized clean air system is that it can be cleaned and sterilized by automatic methods and equipment. The open arrangement and architecture of the clean air system enables automatic cleaning methods and equipment to be used.

Further, the components of the clean air system are arranged to avoid interfering with the automatic cleaning equipment. In addition, the compartmentalized clean air system incorporates radiused corners to avoid collection of liquids.

Yet another advantage of a filling machine having a compartmentalized clean air system is the provision of a substantially vertical air flow by effectively routing air in preselected flow patterns through the filling machine. Also, undesired air turbulence generated by, for example, the rapid movement of the carton and lifter during filling operations, is reduced or alleviated by the vertical air flow generated by the clean air system. The result is a vertical unidirectional air shower which bathes the cartons in a flow of clean air suitable for aseptic packaging.

Another advantage of a filling machine having a compartmentalized clean air system is that it can be arranged to protect the sensitive air system filters in the event of a carton crash. The air foil and air fin, in conjunction with the inlet duct work, provide a labyrinth path, thereby allowing air flow but preventing splashed liquid from accumulating in filters. Therefore, the filters are protected.

DETAILED DESCRIPTION OF THE INVENTION

A filling machine having a compartmentalized clean air system to provide positive pressure to at least one separated portion of the filling machine is provided. The compartmentalized clean air system has an open arrangement and architecture to enable automatic cleaning methods and equipment to be used for cleaning and sterilizing the filling machine.

Figure 1:
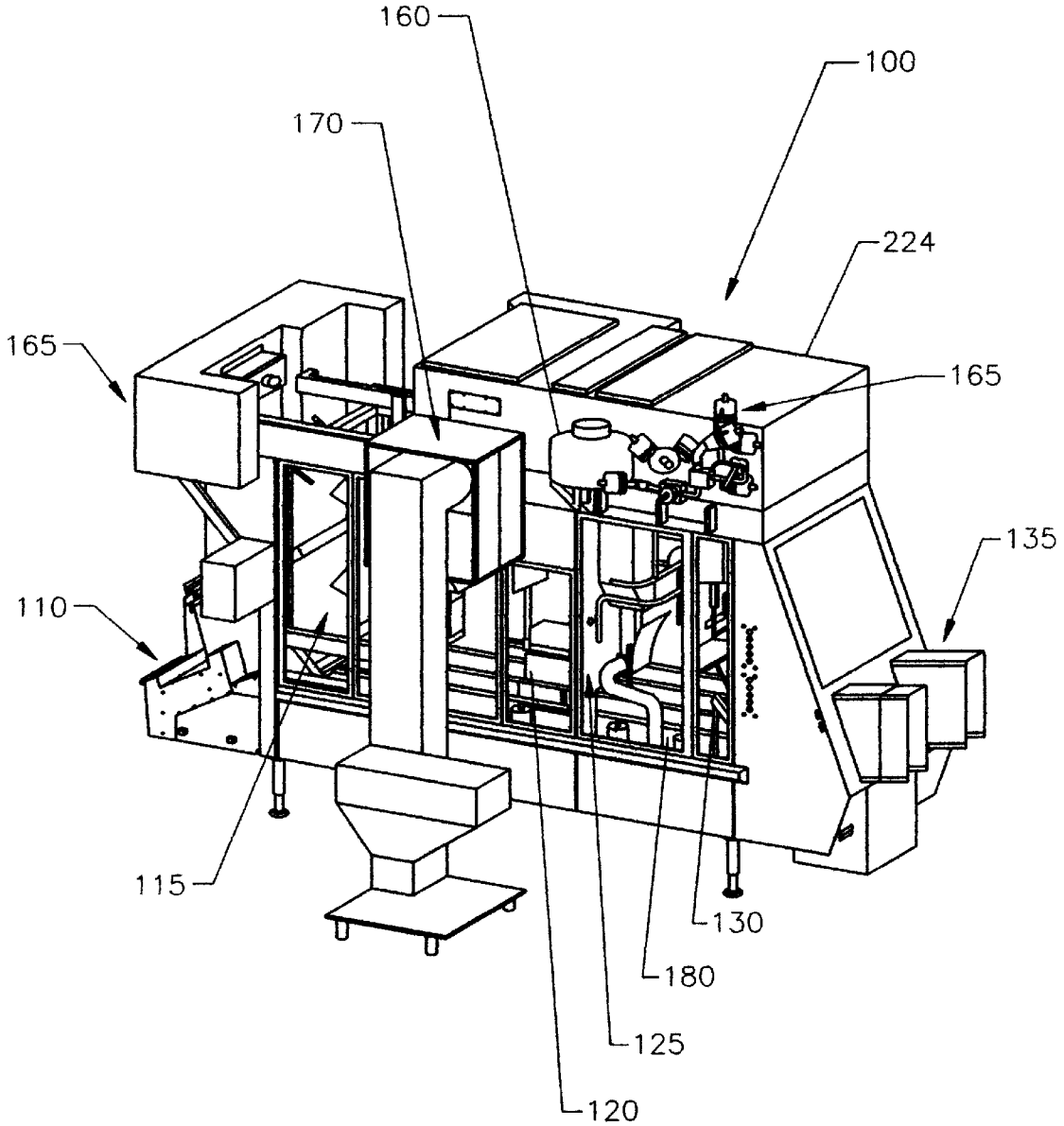
FIG. 1 is a perspective view of an embodiment of a filling machine incorporating a compartmentalized clean air system of the present invention.
Figure 2:
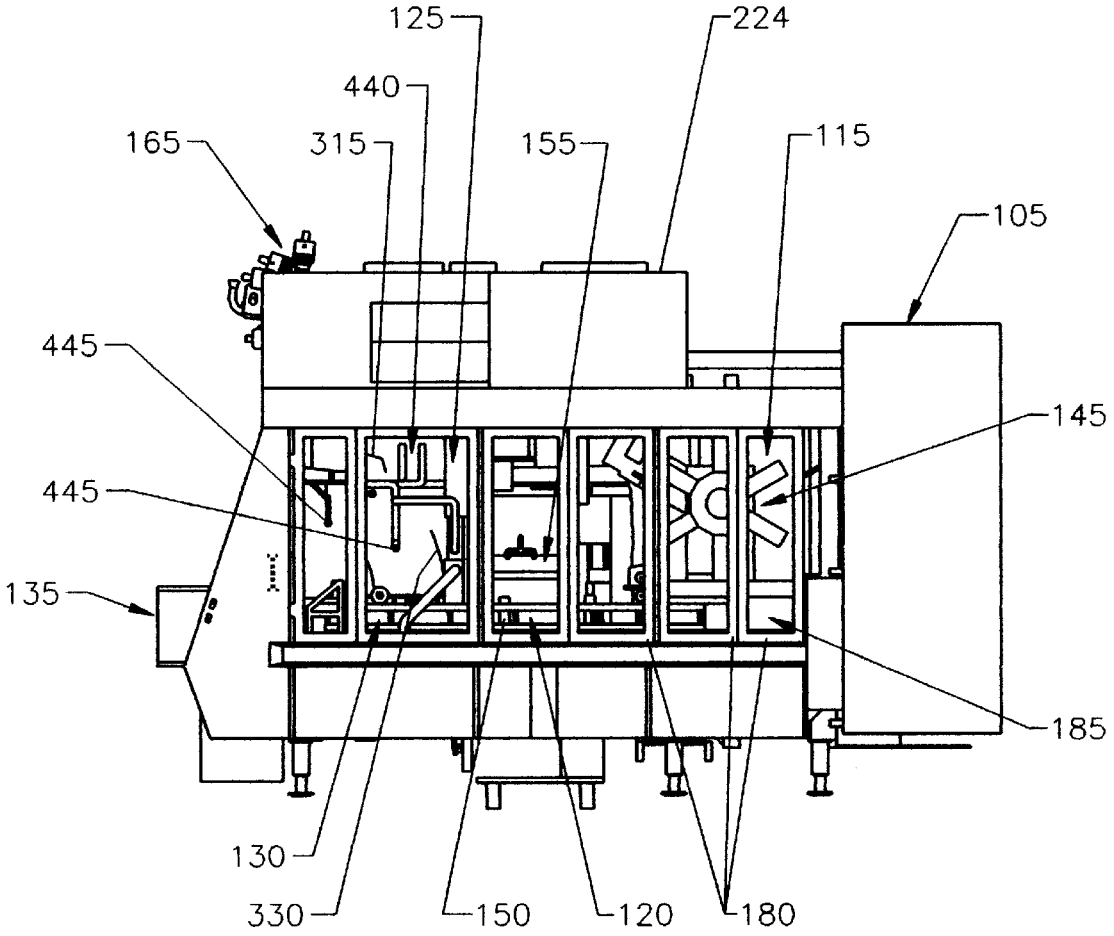
FIG. 2 is a side view of the embodiment of the filling machine of FIG. 1 incorporating a compartmentalized clean air system.
Figure 3:
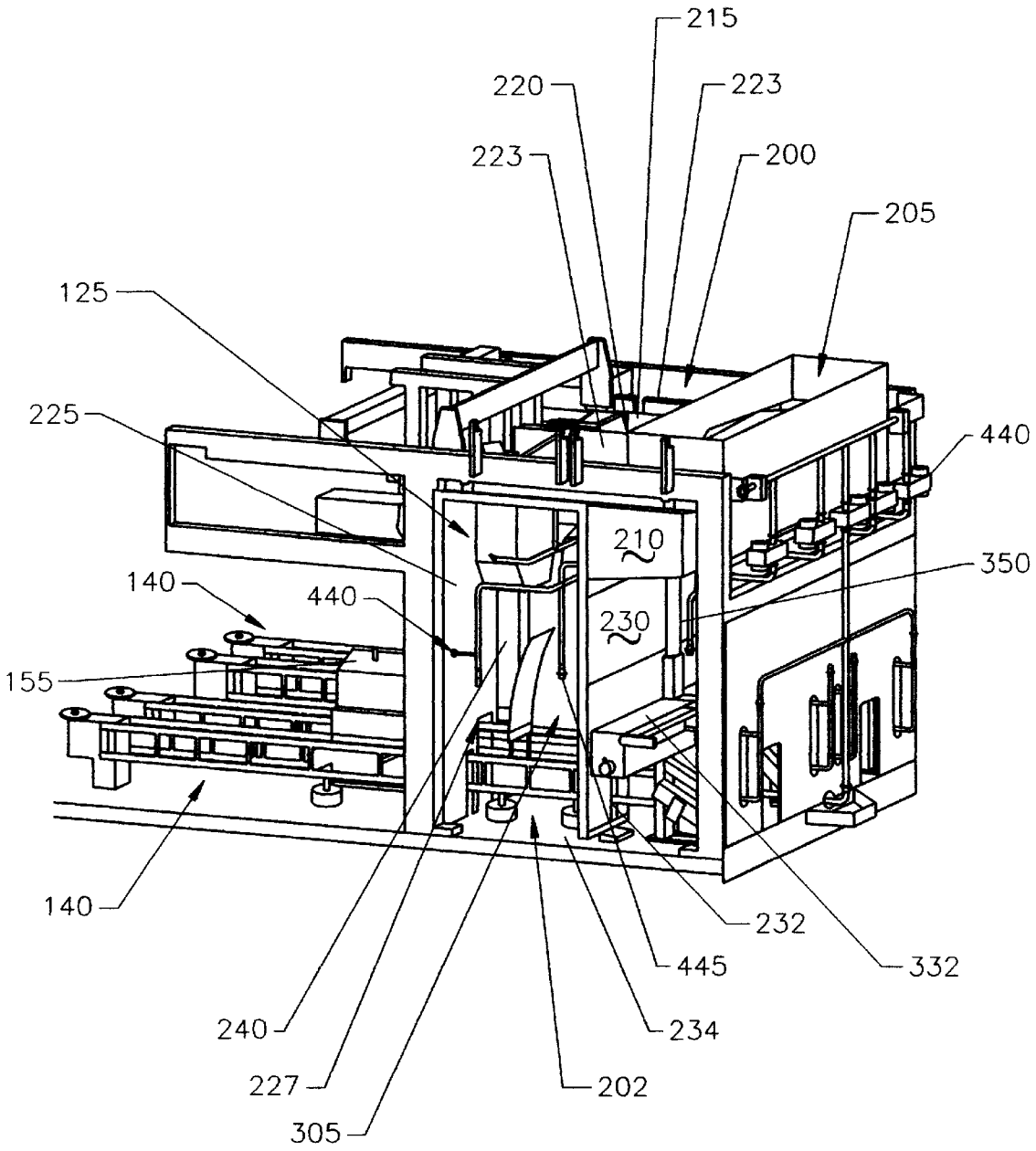
FIG. 3 is a perspective view of the embodiment of the filling machine of FIG. 1 with components removed illustrating the orientation of an embodiment of the compartmentalized clean air system within the machine.

As illustrated in FIGS. 1–3, the filling machine, shown generally at 100, comprises a plurality of machine stations. In the illustrated embodiment, the stations are arranged sequentially within the filling machine 100 as follows: a carton magazine station 110, a carton forming station 115, a sterilizing station 120, a carton filling station 125, a carton sealing station 130 and a carton off-loading station 135. The cartons, gable-top cartons in the illustrated example, are transported between the carton forming station 115, sterilizing station 120, carton filling station 125, carton sealing station 130, and carton off-loading station 135 by a conveyor system 140. The machine stations are, for example, under the control of a control unit that is disposed in a control cabinet 105. The control unit monitors and controls the operation of the filling machine 100. Although the illustrated system is a dual-line machine, it will be recognized that the machine 100 may be constructed as a single line machine as well.

In operation of the machine 100, a supply of carton blanks are arranged at the carton magazine station 110. Individual carton blanks are erected and subsequently removed from the carton magazine station 110 and placed on a mandrel 145 located in the carton forming station 115. While on the mandrel 145, the erected cartons are rotated between subsequent bottom-sealing stations to form a carton having an open top and a sealed bottom. The carton thus has an open top as it enters the sterilizing station 120. At the sterilizing station 120, the cartons are subject to a hydrogen peroxide spray followed by UV irradiation by an ultraviolet light assembly 155 to sterilize the interior of the carton prior to filling with product.

Each sterilized carton is transferred from the sterilizing station 120 to the carton filling station 125 where it is filled with product. The product is provided to each carton through a pump and a fill pipe which are connected to receive product from a balance or intermediate storage tank 160 through a valve cluster 165. One example of such a valve cluster 165 is described in U.S. Pat. No. 5,755,155, entitled Aseptic Process Interface Group; and filed on even date herewith.

Once filled with product, each carton 150 is closed and sealed at the carton sealing station 130. The carton sealing station 130 comprises a top folder mechanism which, for example, uses a pair of opposed wheels to temporarily fold and close the top of the carton. The top sealing station 130 further comprises a top sealer, such as an ultrasonic sealer, that hermetically seals the top of the carton. An example of such a carton sealing station 130 is disclosed in a patent application entitled, "Top Folding and Sealing Apparatus For Forming and Sealing the Fin of a Gabled Carton," U.S. Pat. No. 5,809,743, filed on even date herewith. Other top sealing mechanisms are likewise suitable for use in the illustrated machine. After the carton is filled and sealed, it is transferred out of the filling machine 100 at the off-loading station 135.

FIG. 1 also illustrates an optional screw cap applicator station 170 that is optionally provided to apply a screw cap to each carton. The screw cap applicator station 170 may be constructed in accordance with any known system. It may also include a cap sterilizing station such as the one disclosed in a patent application entitled "Filling Machine Having a Screw Cap Sterilization Apparatus and Method of Operating Same," U.S. patent application Ser. No. 08/828,343, filed on even date herewith. Further, the filling machine 100 includes a plurality of doors 180 arranged to enclose the various stations. The doors 180 preferably have transparent portions 185 to allow observation of the operation of the individual stations.

Figure 4:
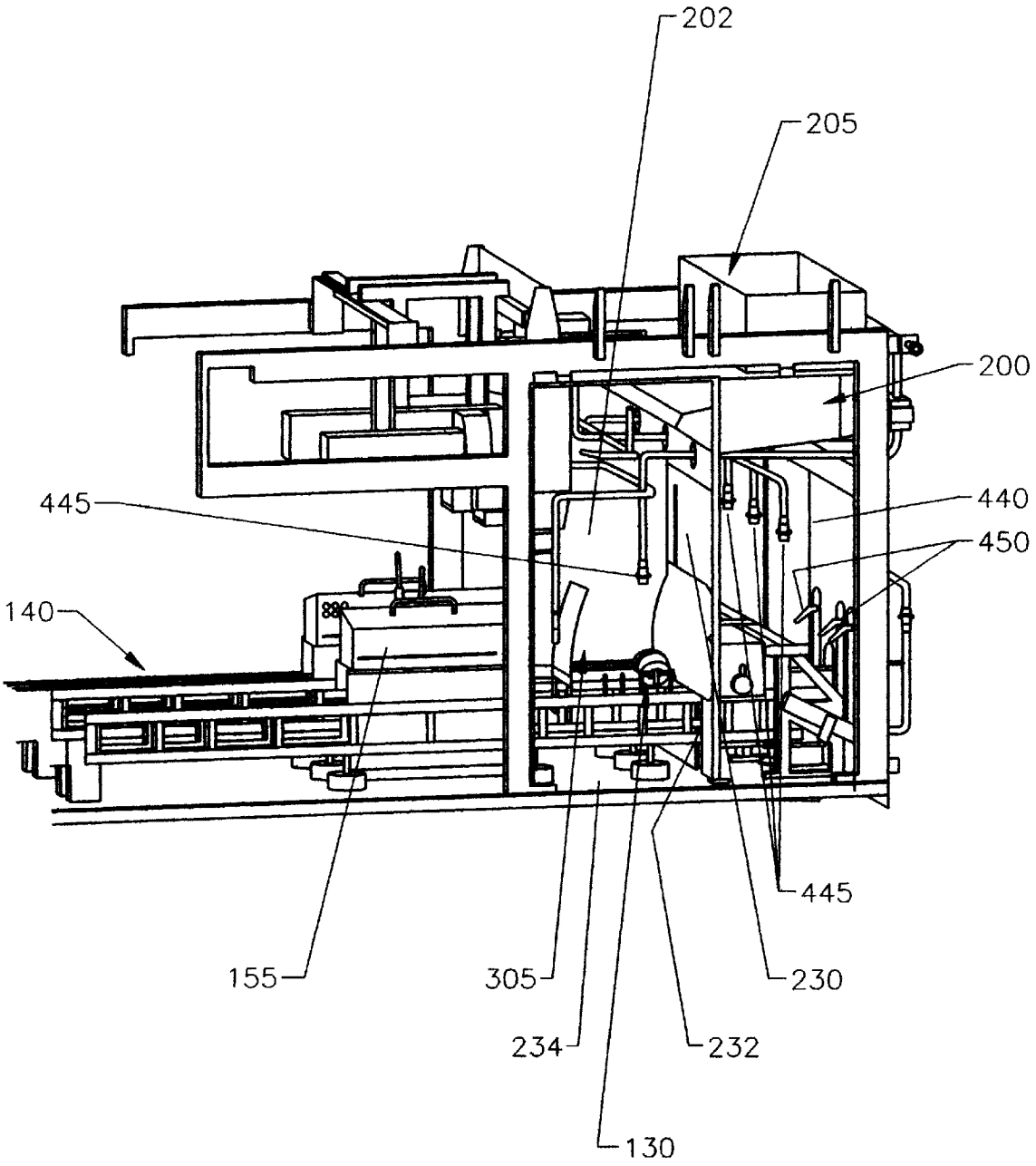
FIG. 4 is another perspective view of an embodiment of a filling machine with components removed illustrating the orientation of an embodiment of the compartmentalized clean air system within the machine.

FIG. 3 is a perspective view of the filling machine 100 with certain components removed (such as the doors 180, etc.) to more clearly illustrate an embodiment of the compartmentalized clean air system arranged therein. FIG. 4 is another perspective view similar to that of FIG. 3.

The compartmentalized clean air system is referenced generally at 200 and effectively encloses the fill station 125 within a positively pressurized chamber 202 having a downward flow of clean air. As will be evident from the following description, the downward flow of clean air is particularly directed about the fill pipe of the filling station so that the filling process is performed in a very hygienic atmosphere. Preferably, at least the top folding portion of the top sealing station is also enclosed in chamber 202.

As illustrated, the compartmentalized clean air system 200 includes an inlet aperture 205 that is part of an upper duct portion 210. The upper duct portion 210 is connected to or part of a roof portion 215 having a peak 220 in the center and sidewalls 223 that slope away from the peak 220 toward each lateral edge of the machine.

Inlet aperture 205 is connected to a source of filtered air. With reference to FIGS. 1 and 2, this filtered air source may be in the form of a microfiltrated air supply system 224 that is located atop the filling machine 100 over the roof portion 215. The air supply system 224 has a filtered air outlet that is connected in fluid communication with the inlet aperture 205. One example of such an air supply system 224 is disclosed in a patent application entitled "Filling Machine Having a Microfiltrated Air Supply System," U.S. patent application Ser. No. 08/828,931, filed on even date herewith. Upper duct portion 210 opens to chamber 202 and includes one or more structures that assist in providing a unidirectional downward flow of sterile air through chamber 202.

In the illustrated embodiment, chamber 202 is defined by a pair of lateral walls that are comprised of glass doors 180 (see FIG. 1 and FIG. 2) and by a pair of transverse walls comprising an entrance wall 225 and an exit wall 230. The entrance wall 225 is substantially vertical and is arranged at the entrance of the chamber 202 enclosing the fill station 125. Entrance wall 225 includes at least one carton aperture 227 through which the cartons are conveyed by conveyor 140 into chamber 202. The exit wall 230 is also substantially vertical and is arranged at a distance from the entrance wall 225. Similarly, the exit wall 230 is provided with an outlet aperture 232 through which the cartons are conveyed by conveyor 140 to exit the chamber 202. The chamber 202 is defined at the upper portion thereof by the roof 215 and at the lower portion thereof by table 234. Thus, the entrance wall 225, the exit wall 230, the side glass doors 180, the table 234, and the roof 215 enclose and define the interior chamber 202. A fill pipe 240 of the filling station 125 is preferably the only component of the fill pump mechanism located in the chamber 202. The top folding portion of the top sealing station is preferably the only portion of the top sealing station that is disposed in the chamber 202. In cases in which the machine 100 is a dual-line machine, a divider wall 305 may be used to separate the fill lines within the chamber 202.

Figure 5:
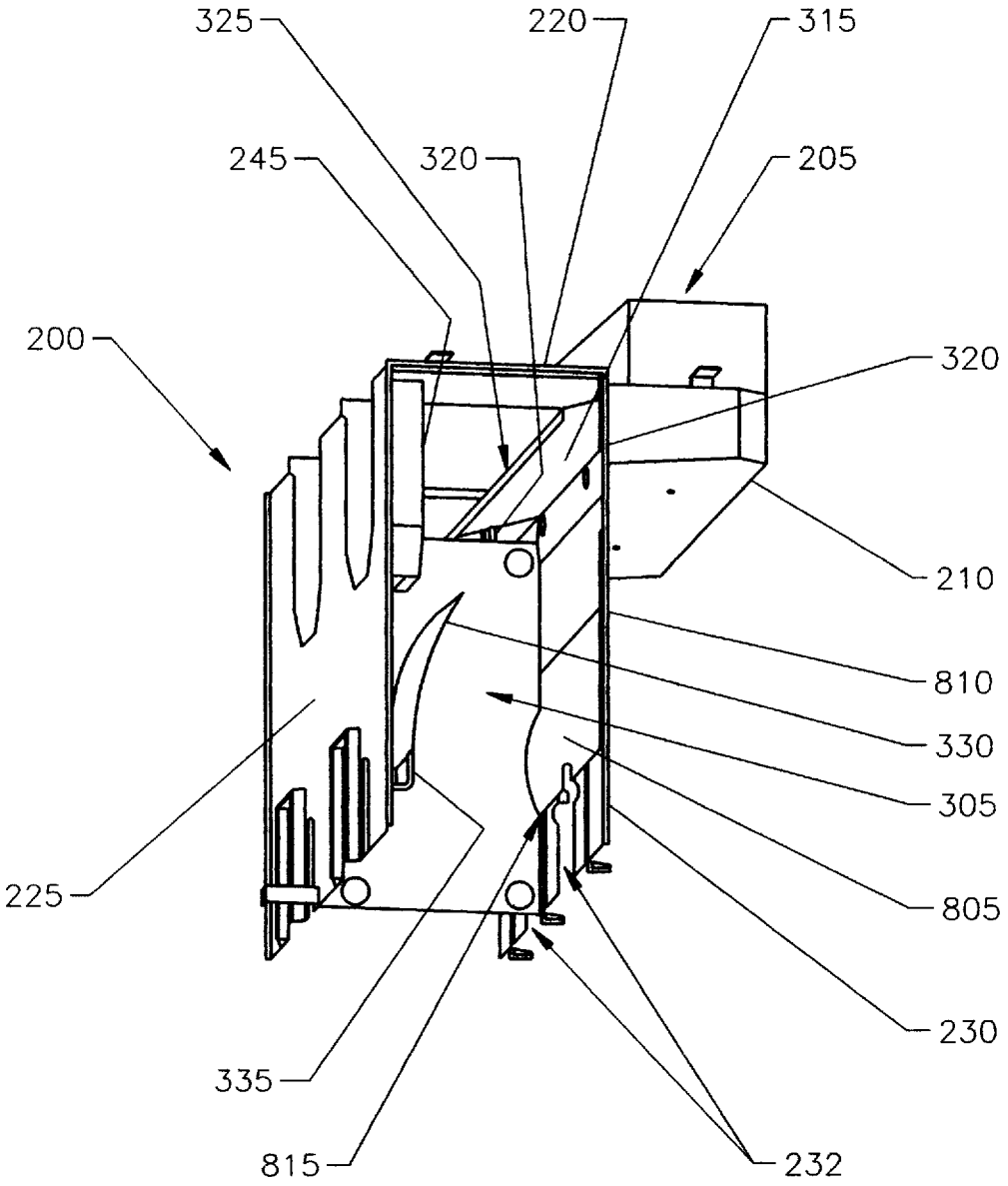
FIG. 5 is a perspective view of an embodiment of the compartmentalized clean air system.

The system 200 includes various structures for directing the air flows within the chamber 202. In the illustrated embodiment of FIG. 5, an air foil 315 supported by a bracket 320 is arranged in the upper duct portion 210 and continues partially into the upper portion of chamber 202. The air foil 315 preferably includes a flap 325 to aid in the directing of the air flow. The preferred flap is fixed and its orientation has been determined by the inventors through extensive testing. Additionally, a fill fin 330 is mounted to the entrance wall 225 within the chamber 202 by a bracket 335. The arcuate fill fin 330 acts to direct the air so that the air flow is increased proximate the fill pipe 240.

Figure 6:
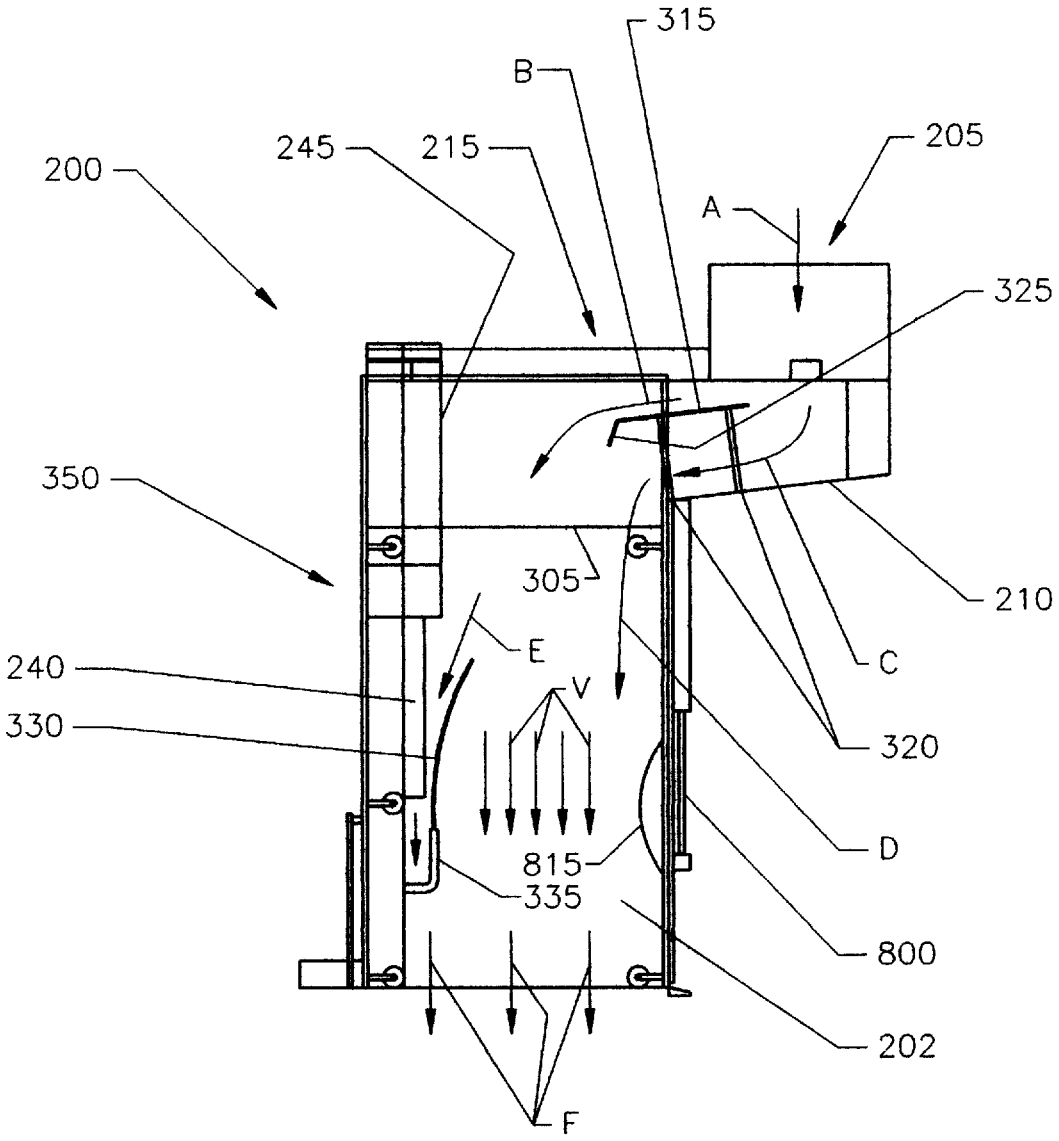
FIG. 6 is a side view of an embodiment of the compartmentalized clean air system.

Operation of the system 200 can be understood with suspect to FIG. 6. As shown, a supply of sterile air, indicated by arrow A, enters the system 200 through the inlet 205. The air supply A is deflected within the upper duct 210 and encounters the air foil 315. The air foil 315 substantially divides the air supply A into two paths B and C. Path B is directed into the chamber 202 and path C is deflected by the flap 325 on the air foil 315 substantially downwardly along the exit wall 230 as indicated by arrow D. A portion of the air from path B, referenced with arrow E, is captured and directed by the fill fin 330. The air in path E experiences an increase in velocity as a result of the curvature of the fill fin 330. Since the curvature of the fill fin 330 decreases the cross sectional area between the fill fin 330 and the entrance wall 225, the velocity of the air in path E must increase by Bernoulli's principle. A vertical air bath exists at a height of approximately two inches above open carton tops. The air bath is indicated by arrows V. The air passes out through the bottom of the filling machine 100 as indicated by arrows F.

As a result of the foregoing arrangement as described, a positive pressure exists in the chamber 202. Since the cartons have just been sterilized and product is present, the filling station and the top folding portion of the top sealing station are the regions requiring the greatest amount of hygienic control. The top folding portion of the top sealing station 130 effectively retains the top flaps of each container in a temporarily closed condition before final sealing by an ultrasonic sealer 332 locate exterior to the chamber 202. As such, the cartons are filled and effectively closed within chamber 202 and are never subsequently opened until opened by the consumer.

The continuous downward flow of air in the chamber 202, which results from the construction of the compartmentalized clean air system 200 as described, increases the hygiene of the chamber 202. Also, the increased velocity air flow in the region of the fill pipe 240 referenced at arrow E has the advantage of overcoming localized turbulence and recirculation caused by machine operation.

For example, during filling cycles the carton is lifted rapidly to meet the fill pipe 240 and subsequently lowered as the carton is filled. Such an operation may be carried out using a carton lifter apparatus as described in U.S. patent application Ser. No. 08/825,207, entitled Improved Seal For A Reciprocating Rod Of A Packaging Machine. While such a filling operation is beneficial for filling the cartons, the sudden and rapid movements of the carton and the lifter create local turbulence which can introduce contaminants into the chamber 202 and the hygienic region of the filling station 125.

To overcome this turbulence, the fill fin 330 is constructed and arranged to increase the air flow in the turbulent region of the moving carton. The air flow indicated at arrow E is sufficient to maintain a continuous downward flow in the turbulent region so that contaminants are kept out of the hygienic filling station 125.

To further enhance the downward flow of air within chamber 202 while concurrently reducing turbulence, it is possible to include a grate in table 234 which allows the sterile air to flow from the chamber 202 to an exterior portion of the machine 100. Alternatively, a vacuum source may be connected to receive air passing through the grate thereby further reducing any turbulence proximate the table 234.

In addition, the open architecture of the clean air system 200 reduces turbulence from the inlet 205, throughout the chamber 202, and out the bottom of the filling machine 100. Further, the divider wall 305 separates the two carton paths from each other. The arrangement of the divider wall 305 between the two carton paths advantageously reduces cross-turbulence.

An additional advantage and benefit of the embodiment of the compartmentalized clean air system 200 described above is the fact that it allows automatic cleaning methods and equipment to be used to clean and sterilize the stations and the filling machine 100. For example, referring to FIGS. 2, 3 and 4, an automatic cleaning system referenced generally at 440 is provided within the filling machine 100. The cleaning system 440 includes a plurality of spray balls 445 and spray jets 450. During a cleaning operation, the spray balls 445 and spray jets 450 comprehensively spray the stations, and in particular, the filling station 125 and the sealing station 130, with a cleaning solution. The compartmentalized clean air system 200 of the present invention is arranged such that the components thereof do not interfere with the automatic cleaning system 440. The microfiltrated air system 224 and filters located therein are protected from In addition, during a carton crash, for example, the air foil 315 actually protects the microfiltrated air supply system 224 by deflecting product back down into the chamber 202. Still further, the lateral offset nature of the inlet 205 relative to the chamber 202 helps to prevent product sprays from entering the microfiltrated air system 224.

Figure 7:
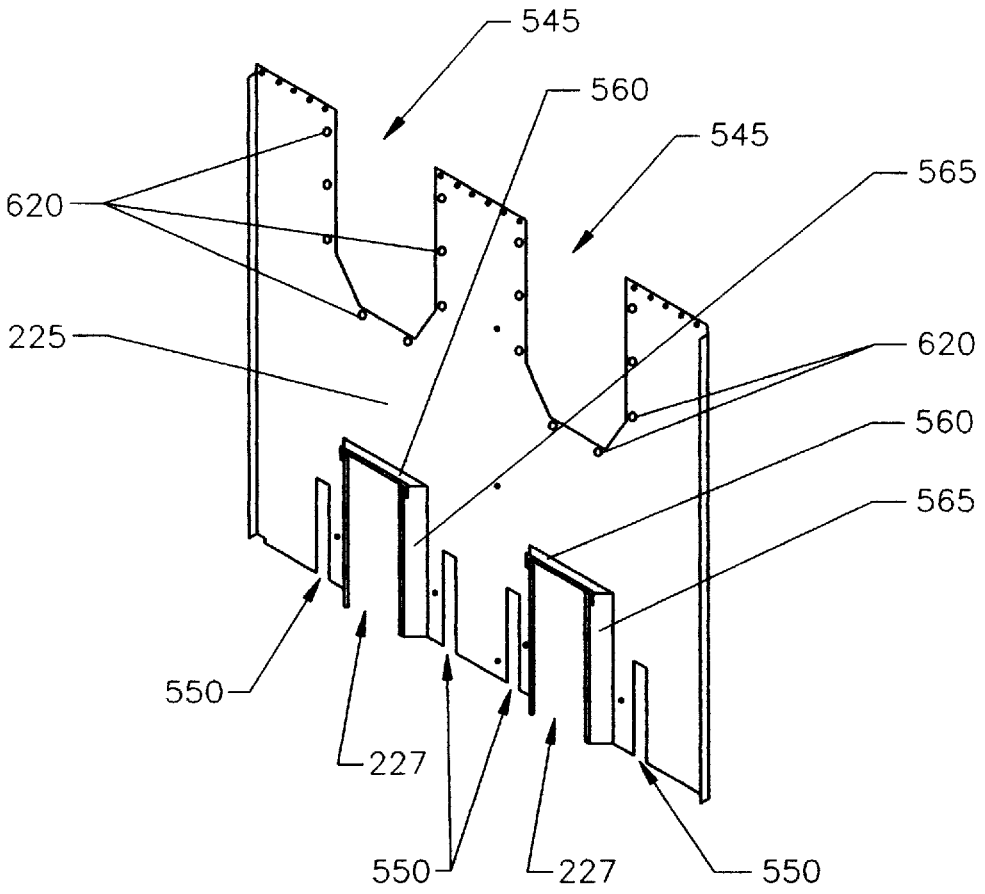
FIG. 7 is a perspective view of an embodiment of an entrance wall for use with the compartmentalized clean air system of the present invention.

Further specific hygiene-enhancing structures are shown and described in connection with the remaining figures. Referring first to FIG. 7, the entrance wall 225 comprises several cut-out portions. More particularly, a pair of pump cut-outs 545 are provided in the upper part of the entrance wall 225 at the intersection with the roof 215. Access slots 550 are provided at the bottom of the entrance wall 225 to allow the conveyor 140 to pass through the entrance wall 225. Finally, the carton pass-through apertures 227 are located at a lower portion of the entrance wall 225.

Figure 8:
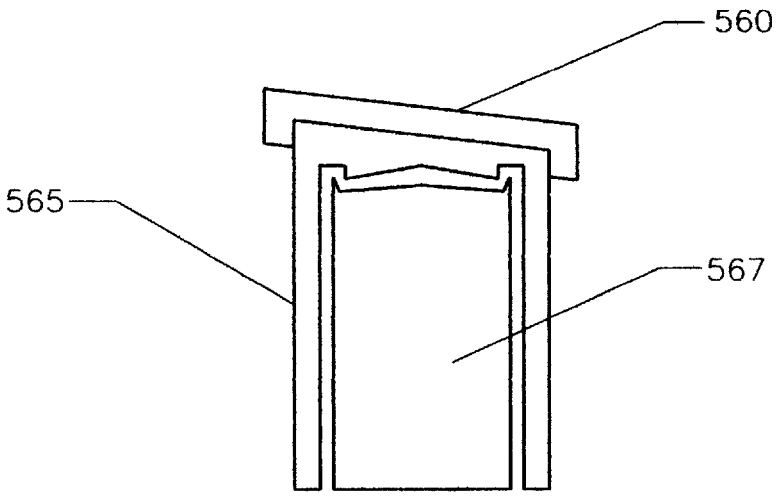
FIG. 8 is a front view of an embodiment of a portion of the entrance wall of the present invention.
Figure 9:
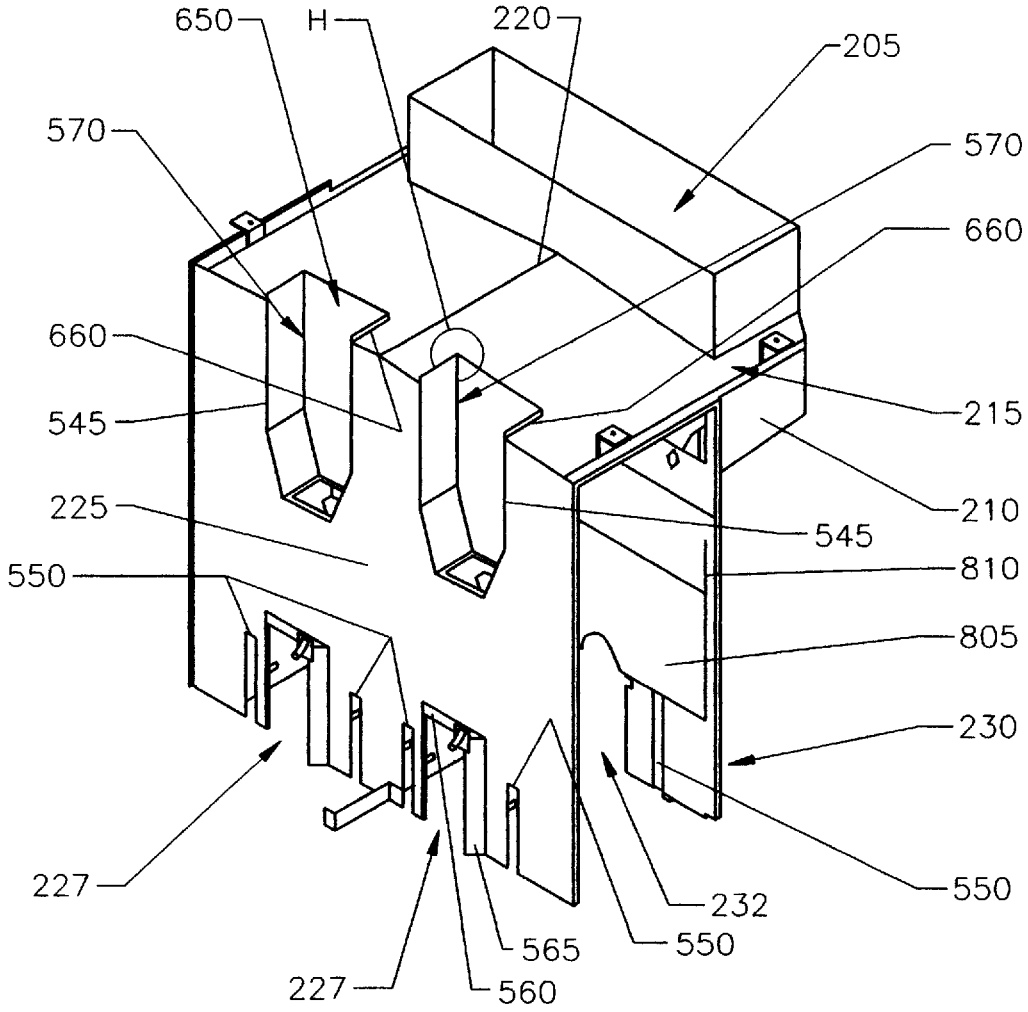
FIG. 9 is another perspective view of an embodiment of the compartmentalized clean air system.

As shown in FIGS. 7, 8, and 9, the carton apertures 227 include a top lip 560 and side lips 565 arranged around the apertures 227. For example, FIG. 7 illustrates a substantially straight cut for the region of the top lip 560. Alternatively, FIG. 8 provides a different possible shape. To provide a more hygienic entrance to the chamber 202, the top lip 560 and the side lips 565 are formed to approximately replicate the profile of carton 567. By providing such an aperture shape, the chamber 202 may be kept more hygienic by restricting the size of the aperture 227 through which contaminants can enter the chamber 202. Further, the top lip 560 is angled to direct any liquid disposed thereon to a lateral side of the machine. As shown in FIG. 9, the exit apertures 232 of the exit wall 230 are similarly constructed. The exit apertures 232 may substantially conform to the shape of the top of a carton.

Figure 10:
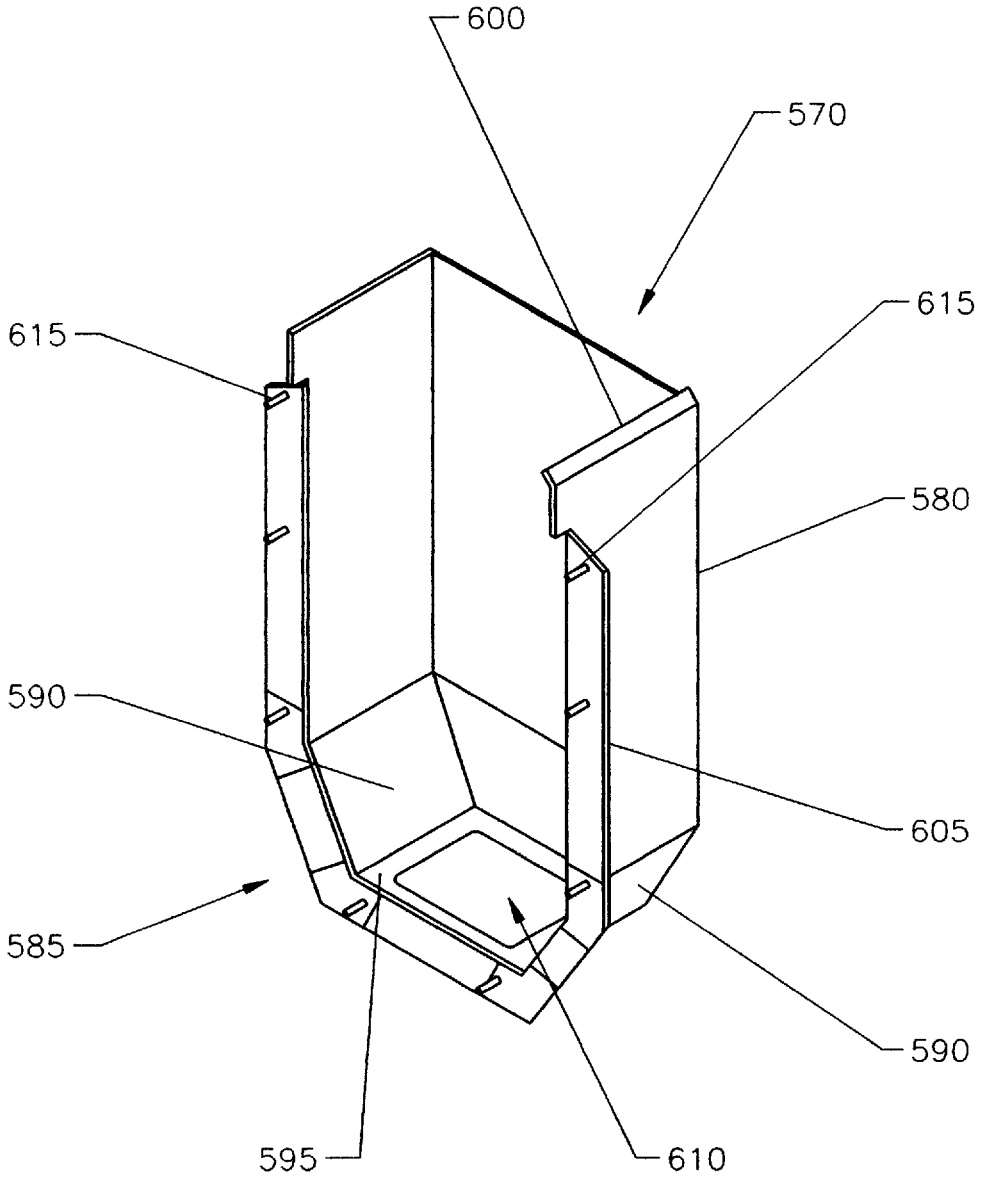
FIG. 10 is a perspective view of an embodiment of a pump cover for use in the compartmentalized clean air system of the present invention.

A pair of pump covers 570 are connected to the entrance wall 225 at the pump cut-outs 545. One embodiment of a pump cover 570 is shown in FIG. 10. The pump cover 570 is provided to encompass part of the filling station 125, namely the fill pump, while allowing the fill pipe 240 to project through the pump cover 570 into the chamber 202. In this manner, the generally non-hygienic, moving components of the fill pump are not allowed to contaminate the chamber 202 with debris.

The pump cover 570 comprises a shroud 580 that encloses the fill pump and a fill pipe aperture 610 that is disposed at a bottom portion 585. As shown, the bottom portion 585 includes angled sections 590 and a substantially horizontal section 595. A top flange 600 is arranged at an edge of the shroud 580 and forms an interface with the roof 215.

The fill pipe aperture 610 is formed in the horizontal section 595. The aperture 610 is appropriately dimensioned to allow the fill pipe 240 to pass through. The aperture 610 may be oversized to allow for positional tolerances with respect to the location of the fill pipe 240 relative to the pump cover 570. To compensate for any gap that may exist between the fill pipe 240 and the aperture 610, a gasket (not shown) may be used as a seal between the outside diameter of the fill pipe 240 and the inside diameter of the aperture 610. Alternatively, or in addition top a flexible fill pipe sleeve may be provided.

A mounting flange 605 is provided on the pump cover 570 to secure the pump cover to the entrance wall 225. The mounting flange 605 includes a plurality of apertures with securements 615 disposed therethrough. The securements 615 engage a corresponding plurality of slotted apertures 620 that are formed in the entrance wall 225 around the periphery of the pump cut-outs 545. The pump covers 570 are secured to the entrance wall 225 via the securements that pass through the slotted apertures 620. Each securement 615 can thus be adjustably positioned within the slotted aperture 620 to compensate for construction tolerances that accumulate in the filling machine 100. This compensating feature provides for better sealing of the pump covers 570, thereby increasing the hygiene of the chamber 202.

Figure 11:
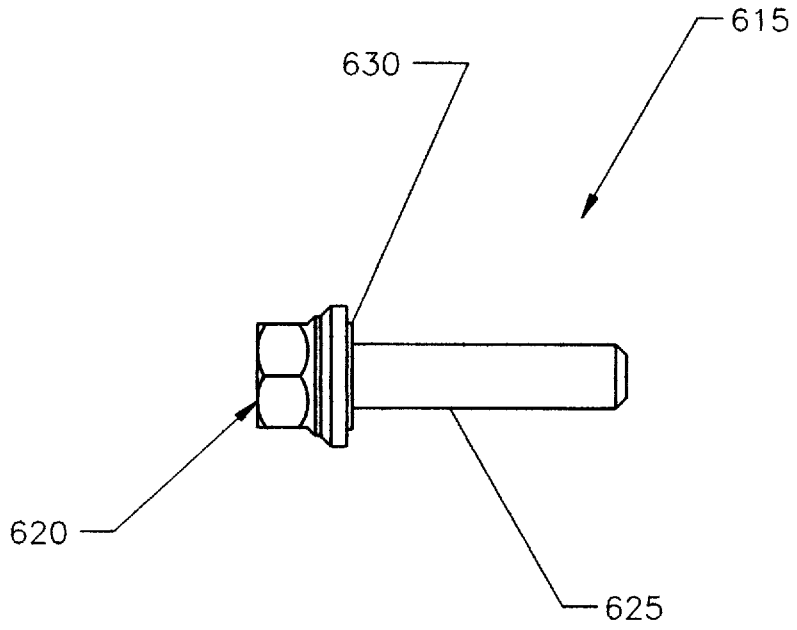
FIG. 11 is an embodiment of a screw for use in the compartmentalized clean air system of the present invention.

The securements 615 used in the illustrated embodiment are preferably screws such as the one shown in FIG. 11. As illustrated, each screw 615 includes a hex head 620 and a shaft 625 that have been modified to increase its hygienic properties. For example, the sharp edges on the hex head 620 of the screw 615 are smoothed or rounded off. Further, the screw 615 includes a stepped portion 630 so that when a gasket (not shown) is used with the screw 615, no crevice results between the hex head 620 and the material being secured.

Figure 12A:
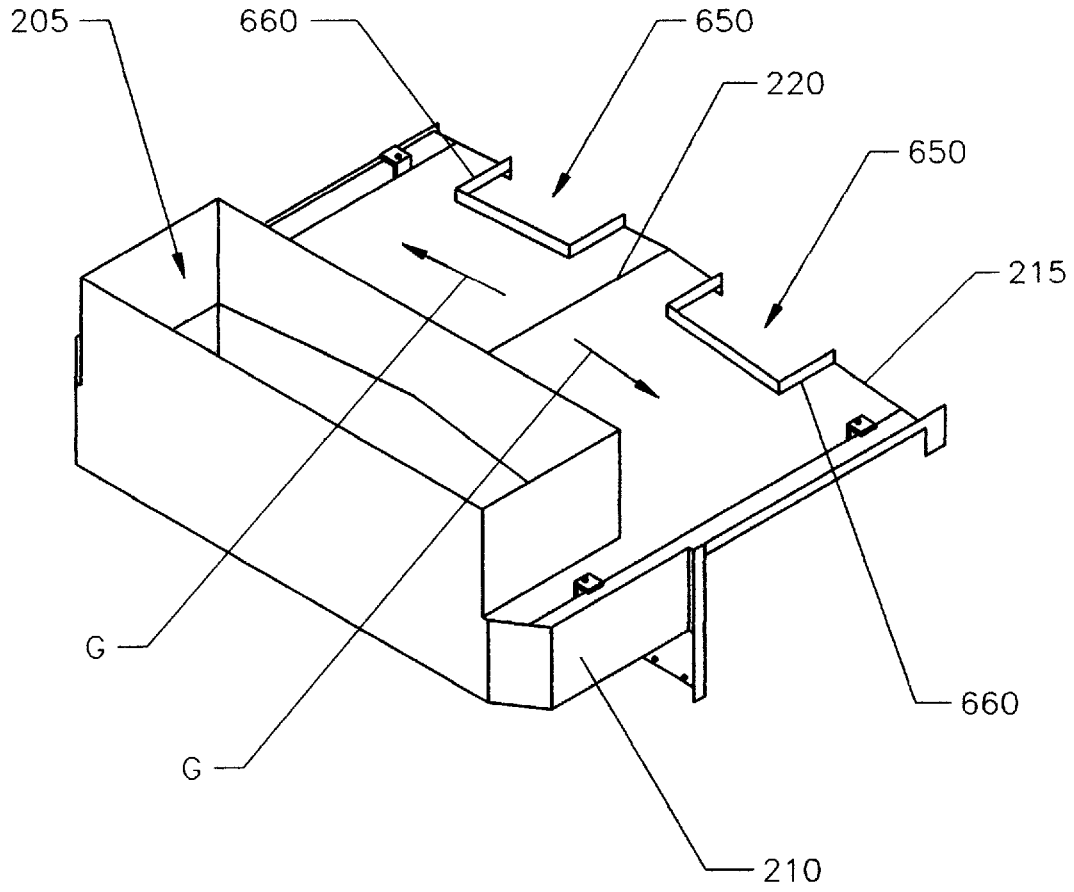
FIG. 12A is a top perspective view of a portion of an embodiment of a compartmentalized clean air system of the present invention.
Figure 12B:
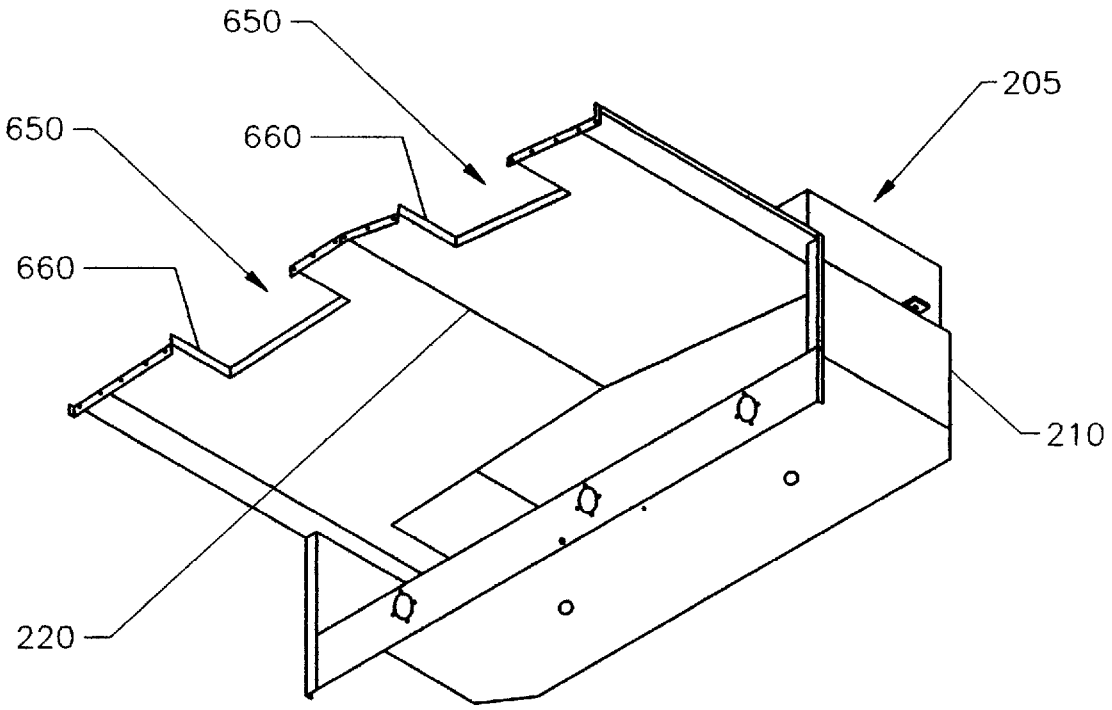
FIG. 12B is a bottom perspective view of the portion of the embodiment of the compartmentalized clean air system of FIG. 12A.

FIG. 12A is a top perspective view of the inlet portion 205, the upper duct 210, and the roof portion 215 of the clean air system 200 while FIG. 12B is a bottom perspective view thereof. The peak 220 of the roof portion 215 is located approximately in the center to provide a slope away from the center to each lateral edge. The slope is preferably finished so that a grain direction indicated by arrow G is provided. This grain direction may be established by creating parallel grooves in the grain direction G. This can be done by grinding or other known finishing techniques. The combination of the slope and the grain directing grooves facilitates the removal of fluid and other spills that may fall onto the roof portion 215 down to the edges of the roof 215. A pair of roof cut-outs 650 are formed in the roof portion 215. A flange 660 substantially surrounds the roof cut-outs 650 in the roof portion 215.

Figure 13:
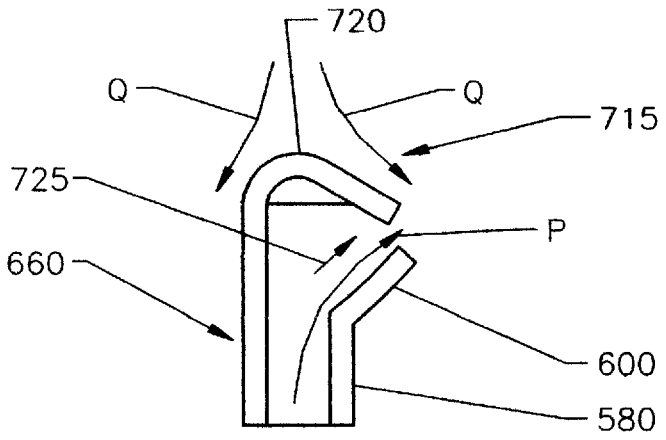
FIG. 13 is a detail view illustrating an arrangement of the pump cover of FIG. 10 within the compartmentalized clean air system of the present invention.

The pump cover 570 forms an interface with the roof portion 215 at the cut-outs 650 and the flanges 660. To compensate for accumulated tolerances, the pump cover 570 is preferably not directly connected to the roof portion 215. Instead, a labyrinth-type sealing arrangement 715 as illustrated in FIG. 13 is provided. FIG. 13 is a detail view of a portion of the interface of the pump cover 570 and the flange 660 at the roof cut-out 275 such as that illustrated at region H of FIG. 9.

The flange 660 on the roof portion 215 includes an inverted J-shaped lip 720. The top flange 600 of the shroud 580 of the pump cover 570 is situated beneath the inverted J-shaped lip 720. A gap 725 is provided between the top flange 600 and the lip 720. The gap 725 allows air to flow out of the chamber 202 due to the positive pressure maintained in the chamber 202. Such an outward flow is indicated by arrow P. While the labyrinth-type sealing arrangement 715 allows air to escape, it does not allow contaminants to enter the chamber 202 through this region. As shown by arrows Q, contaminants from outside cannot enter.

With reference again to FIGS. 5 and 6, a lifting mechanism 800 for raising and lowering a door panel 805 on the exit wall 230 is illustrated. The door panel 805 is periodically raised and lowered to service the components of the top sealing station. For example, the lifting mechanism 800 is operated to lift the door panel 805 a sufficient distance to provide adequate clearance for the ultrasonic top sealer 332 to swing upwardly in an arc to facilitate maintenance and assembly. It is also automatically cycled during cleaning to allow for cleaning access to the top sealer 332.

As shown in FIG. 6, the divider wall 305, which provides a hygienic barrier between the two carton conveyor paths, further includes an arched cut-out 815. In preparation for a cleaning operation or maintenance, the door panel 805 can be raised using the lifting mechanism 800. After the door panel 805 has been raised, the arched cut-out 815 allows the sealing station 130 to swing upwardly in an arc corresponding to the arched cut-out 815 for cleaning or maintenance when required.

Referring back to FIG. 2, the apparatus and arrangement of the compartmentalized clean air system provides segregated positive pressure zones within the filling machine 100. Such an arrangement provides varying levels of hygiene throughout the filling machine 100. For example the relative pressures for regions illustrated from left to right in FIG. 2 are as follows:

The pressure at the carton off-loading station 135 is approximately atmospheric; the pressure in the region of the carton sealing station 130 is greater than atmospheric; the pressure in the region of the carton filling station 125 is a relative maximum and therefore greater than that of the carton sealing station 130 and the sterilizing station 120 and the carton forming station 115; finally, the pressure at the carton magazine station 110 is again atmospheric. Thus, the carton filling station 125, which requires the greatest hygiene is maintained at the relative maximum pressure and has a positive vertical downward air bath in the chamber 202.

Figure 14:
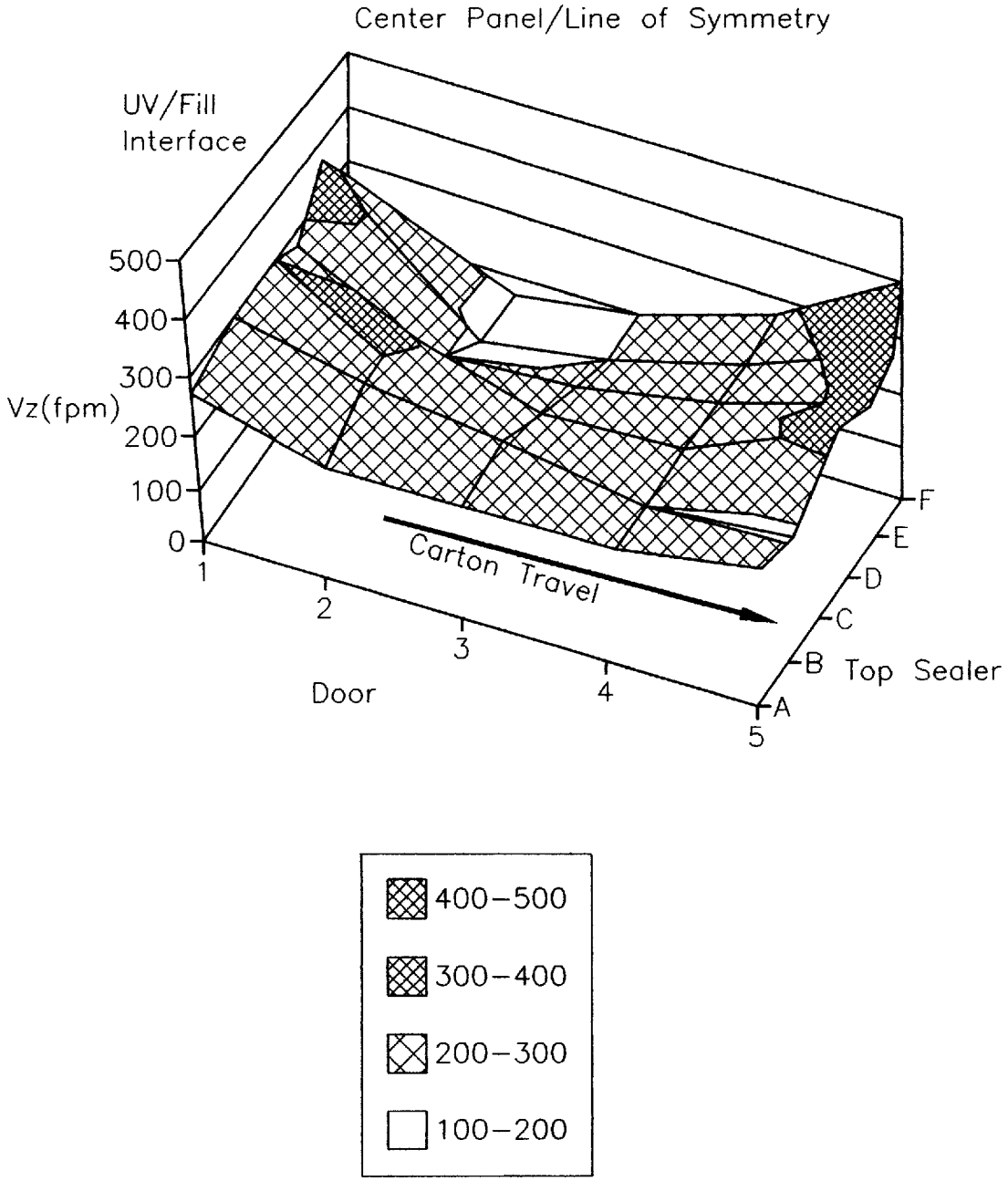
FIG. 14 is a graph illustrating the vertical air velocity distribution in the region of interest at an initial stage when the system is operating at maximum capacity.
Figure 15:
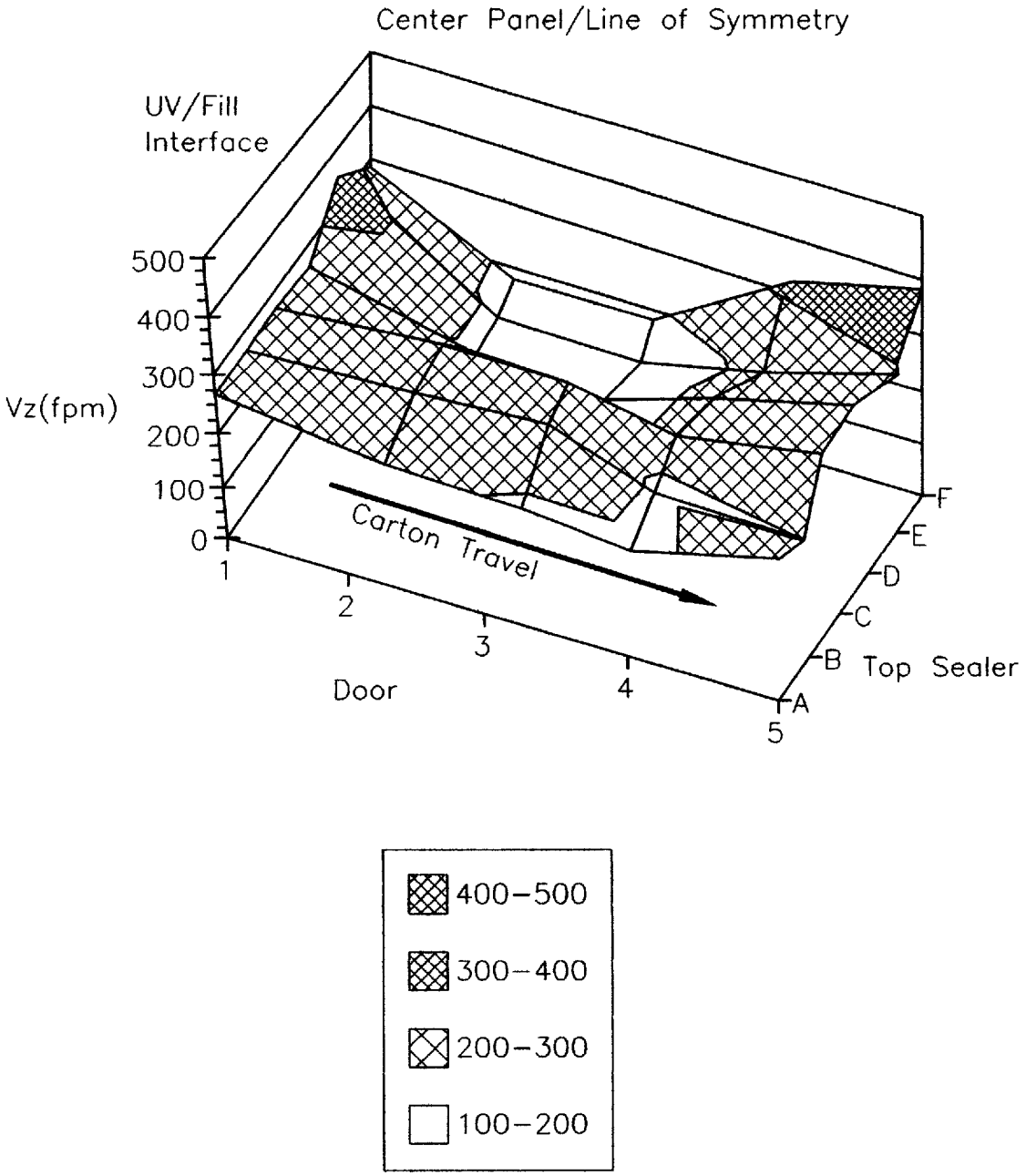
FIG. 15 is a graph illustrating the vertical air velocity distribution in the region of interest at a later stage when air filters in the system are at the end of their effective life.

Similarly, as explained above, the filling machine 100 is awash in a vertical airbath. In addition, regions requiring maximum hygiene are provided with the maximum vertical downward airflow. FIGS. 14 and 15 graphically illustrate the vertical air velocity distribution from the interface between the sterilizing station 120 and the carton filling station 125 to the carton top sealing station 130. The region of interest is also delimited by the center panel 305 and the door 180.

FIG. 14 illustrates the vertical air velocity in the region of interest at an initial stage when the system is operating at maximum capacity. Whereas, FIG. 15 illustrates the vertical air velocity in the region of interest at a later stage when air filters in the system are at the end of their effective life. Comparison of the two figures shows how the vertical air velocity decreases as the filters degrade. However, the velocity distribution remains basically proportionate so that critical areas (for example, near the fill pipe) have the highest velocity air.

While particular elements, embodiments and applications of the present invention have been shown and described, it will be understood, of course, that the invention is not limited thereto since modifications may be made by those skilled in the art, particularly in light of the foregoing teachings. It is therefore contemplated by the appended claims to cover such modifications as incorporate those features which come within the spirit and scope of the invention.

We claim:

1. A packaging machine for forming, filling and sealing a series of cartons being conveyed along a linear path, the packaging machine comprising:

a sterilizing station;

a top sealing station;

a substantially enclosed filling chamber disposed between the sterilizing station and the top sealing station, the filling chamber having an entrance wall and an exit wall;

a filling tube for filling each of the cartons with a product, the filling tube diposed within the filling chamber;

a clean air supply system in flow communication with the filling chamber through a duct having an outlet at the top of the filling chamber, the duct having an air foil that is composed of a first portion and a second portion, the first portion disposed at least partially in and oriented horizontally relative to the duct, the second portion oriented vertically to the first portion in order to deflect clean air from the clean air supply system into the filling chamber in a downward, vertical, unidirectional manner;

an arcuate fill fin mounted to the entrance wall in proximity to the fill pipe in order to increase the velocity of the air directed towards the fill pipe; and a top folding device for folding and closing a top of each of the series of cartons prior to top sealing at the top sealing station, the top folding device disposed at least partially within the filling chamber.

2. The packaging machine according to claim 1 further comprising a pumping mechanism for pumping the product through the fill pipe, the pumping mechanism enclosed by a pump cover having an aperture for placement of the fill pipe therethrough whereby the pump cover prevents possible contamination of the fill chamber by the pumping mechanism.

3. The packaging machine according to claim 1 further comprising a lateral offset inlet juxtaposed between the duct and the clean air supply system whereby the offset inlet prevents contamination of the clean air supply system by misfilled product.

4. The packaging machine according to claim 1 further comprising a clean-in-place system disposed within the filling chamber.

5. The packaging machine according to claim 1 further comprising a lifting mechanism for lifting each of the series of cartons for bottom-up filling.

* * * * *